US007114196B1

(12) United States Patent
Cicio

(10) Patent No.: US 7,114,196 B1
(45) Date of Patent: Oct. 3, 2006

(54) VEHICLE SAFETY BELT WEIGHT STABILIZATION DEVICE

(76) Inventor: Gary Cicio, 569 Beach Rd., Mahopac, NY (US) 10541

( * ) Notice: Subject to any disclaimer, the term of this patent is extended or adjusted under 35 U.S.C. 154(b) by 83 days.

(21) Appl. No.: 10/830,815

(22) Filed: Apr. 23, 2004

(51) Int. Cl.
*A41F 3/02* (2006.01)

(52) U.S. Cl. ..... 2/338

(58) Field of Classification Search ..... 2/311, 2/312, 338, 317–325; 280/290; 182/3; 180/268
See application file for complete search history.

(56) References Cited

U.S. PATENT DOCUMENTS

| | | | | |
|---|---|---|---|---|
| 3,487,474 | A | 1/1970 | De Meo | 2/311 |
| 3,533,107 | A | 10/1970 | Raneri et al. | 2/93 |
| 3,562,812 | A | 2/1971 | Greggains | 2/94 |
| 3,564,616 | A | 2/1971 | Battaglia | 2/311 |
| 3,896,499 | A | 7/1975 | Kelly | 2/311 |
| 4,028,742 | A | 6/1977 | Marquis | 2/305 |
| 4,111,448 | A | 9/1978 | Sklodowsky | 280/289 |
| 4,411,222 | A | 10/1983 | Wolfson | 119/96 |
| 4,413,358 | A * | 11/1983 | Jimenez | 2/321 |
| 5,002,149 | A | 3/1991 | Watanabe et al. | 180/219 |
| 5,081,719 | A | 1/1992 | Donnelly | 2/311 |
| 5,152,013 | A | 10/1992 | Johnson | 2/321 |
| 5,184,696 | A * | 2/1993 | Meed et al. | 182/9 |
| 6,167,572 | B1 | 1/2001 | Naumovitz | 2/227 |
| 6,508,389 | B1 * | 1/2003 | Ripoyla et al. | 224/157 |
| 6,688,259 | B1 * | 2/2004 | Axel | 119/792 |

OTHER PUBLICATIONS

"Hangalls" photocopy of actual product No. 138-830 marketed by WorkForce, Atlanta, Georgia, undated.

* cited by examiner

*Primary Examiner*—Tejash Patel
(74) *Attorney, Agent, or Firm*—Standley Law Group LLP

(57) ABSTRACT

The present invention is to be utilized as a safety device for a passenger riding a vehicle in tandem with the vehicle's operator. The invention is a safety belt device that allows for the passenger to securely grasp one or two handgrips attached to a belt worn around the operator's waist. This invention allow for the passenger to better maintain and stabilize their balance, preventing possible accidents or injury.

20 Claims, 4 Drawing Sheets

Figure 1
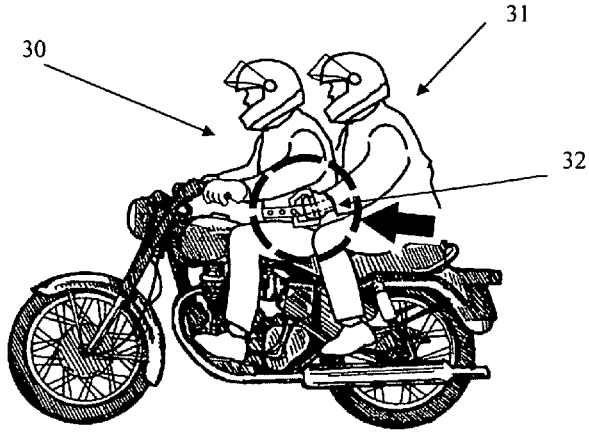
Fig. 1a
Fig. 1b
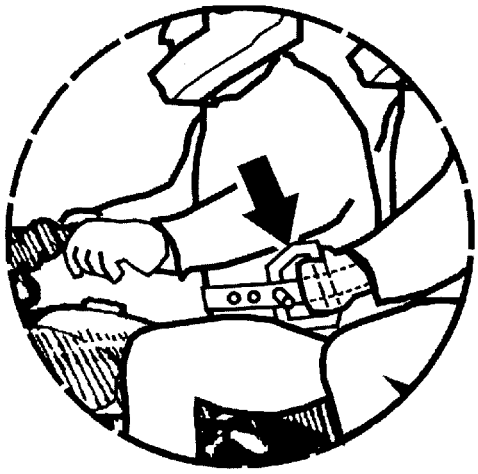
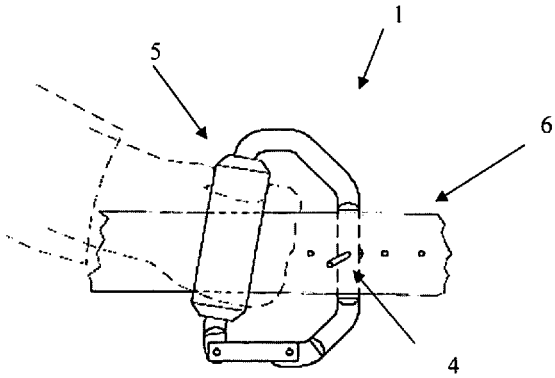
Fig. 1c

Figure 3
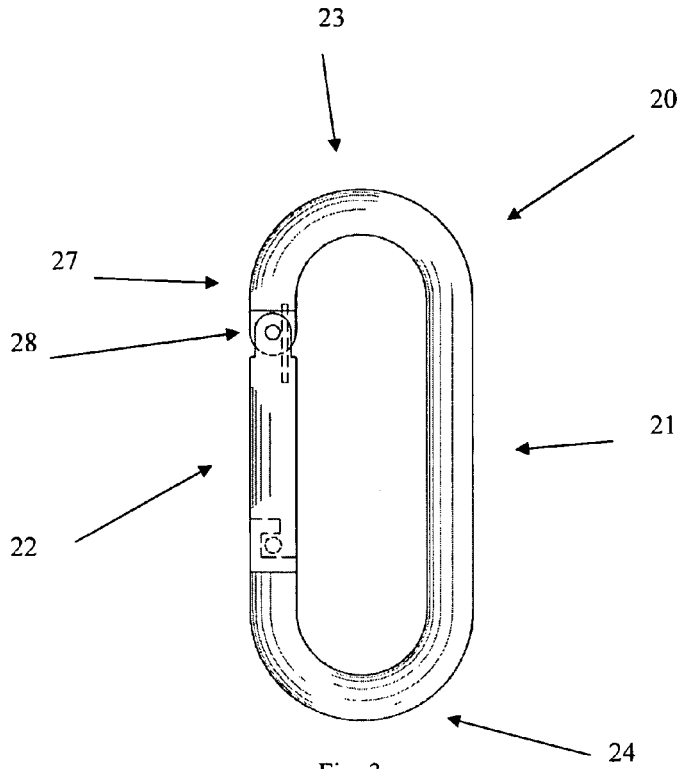
Fig. 3a
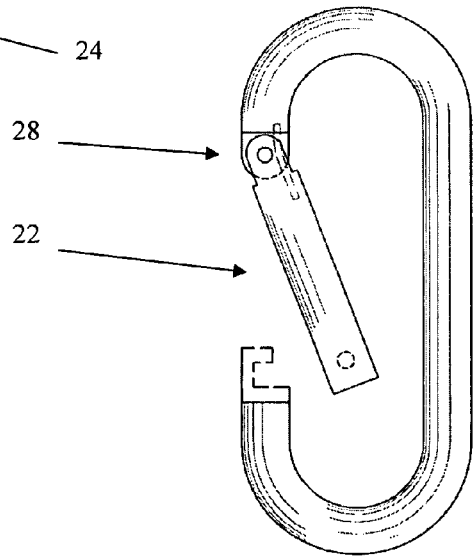
Fig. 3b

VEHICLE SAFETY BELT WEIGHT STABILIZATION DEVICE

BACKGROUND AND SUMMARY OF THE INVENTION

The present invention is intended to be used as a safety device for passengers riding in tandem with the operator of an open-air vehicle, where the term "riding in tandem" refers to the practice where the passenger is situated directly behind the operator of the vehicle. The primary intention of the present invention is that it be used by passengers riding on a motorcycle, but this device may also be used in conjunction with other vehicles such as snowmobiles, all terrain vehicles (ATV's), wave runners or similar sports vehicles. The operator of such a vehicle, having the vehicle's handlebars to hold onto, has little problem in stabilizing their balance or maintaining their position on the vehicle. The passenger, not having handlebars to hold onto, must wrap their arms around the operators waist, or cling to the adjacent sides of the vehicle's seat to stabilize their balance. This practice is both cumbersome and inefficient.

The present invention is intended to solve this problem by allowing a passenger riding in tandem on a motorcycle, snowmobile, ATV, wave runner or similar sports vehicle, a more convenient and effective means to stabilize their balance and secure their position on the vehicle. This invention will not only increase the passengers comfort, but should also result in the reduction or prevention of significant weight shifts during travel.

The use of a safety belt device, allowing a passenger riding in tandem better weight stabilization, is not a new concept. There have been other attempts made in the past to create such a device, some of which have been successful. However, the present invention contains advantages not found in the prior art.

One advantage of the present invention can be found in its simplicity. In one preferred embodiment, the present invention is an adaptation of a common device, known as a carabiner. These devices are readily available at a low cost, and may be adapted to form a part of the present invention. These factors make the present invention economical to manufacture, giving it a commercial benefit over the prior art.

An additional advantage of the present invention is that its compact size allows for easy storage. One disadvantage of a motorcycle, as compared to other automotive vehicles, is that it lacks storage space. Prior art systems employed specialized belts and cumbersome gripping mechanisms, requiring significant storage space. The belt or straps used in the present invention may be the same as any other belt or strap except that it is preferably modified with two laterally placed sets of holes (one on each side of the operator's waist) used for connection with the carabiner's sliding pins. While not being used as a stabilization device the carabiners may be easily removed from the belt or strap and stored. The operator may elect to wear the belt or strap(s) while off of the vehicle. The ability of the safety belt or strap to be worn by the operator while off the vehicle eliminates having to store a specialized belt on the motorcycle. Summarizing, the belt or strap(s) and the carabiner handles may be stored with the vehicle or taken with the rider/operator of the vehicle after the vehicle is parked.

The present invention, in one preferred form, consists of at least one carabiner, a handgrip, a sliding pin, and a locking mechanism. A passenger, riding in tandem on a motorcycle, clips preferably two carabiners around a belt worn by the operator. Each carabiner may be secured to the belt through the sliding pin through a hole in the belt. The exact location of these holes may vary, but they are preferably located near the operator's hips. Once the sliding pin has been inserted through the belt, the locking mechanism may be used to secure the position of the sliding pin, ensuring that the carabiner handles remain in place. With the carabiner handles securely attached to the belt worn around the operator's waist, the passenger grasps onto the handles and the vehicle is operated in normal fashion. As the vehicle accelerates or changes momentum the passenger uses the handles to maintain their balance, stabilize their position and insure a more secure ride.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which:

FIGS. 1*a*, 1*b* and 1*c* illustrate the operation of the present invention.

FIGS. 3*a* and 3*b* illustrate a closed and open carabiner.

DETAILED DESCRIPTION OF THE PREFERRED EMBOFDIMENT

Figure 2:
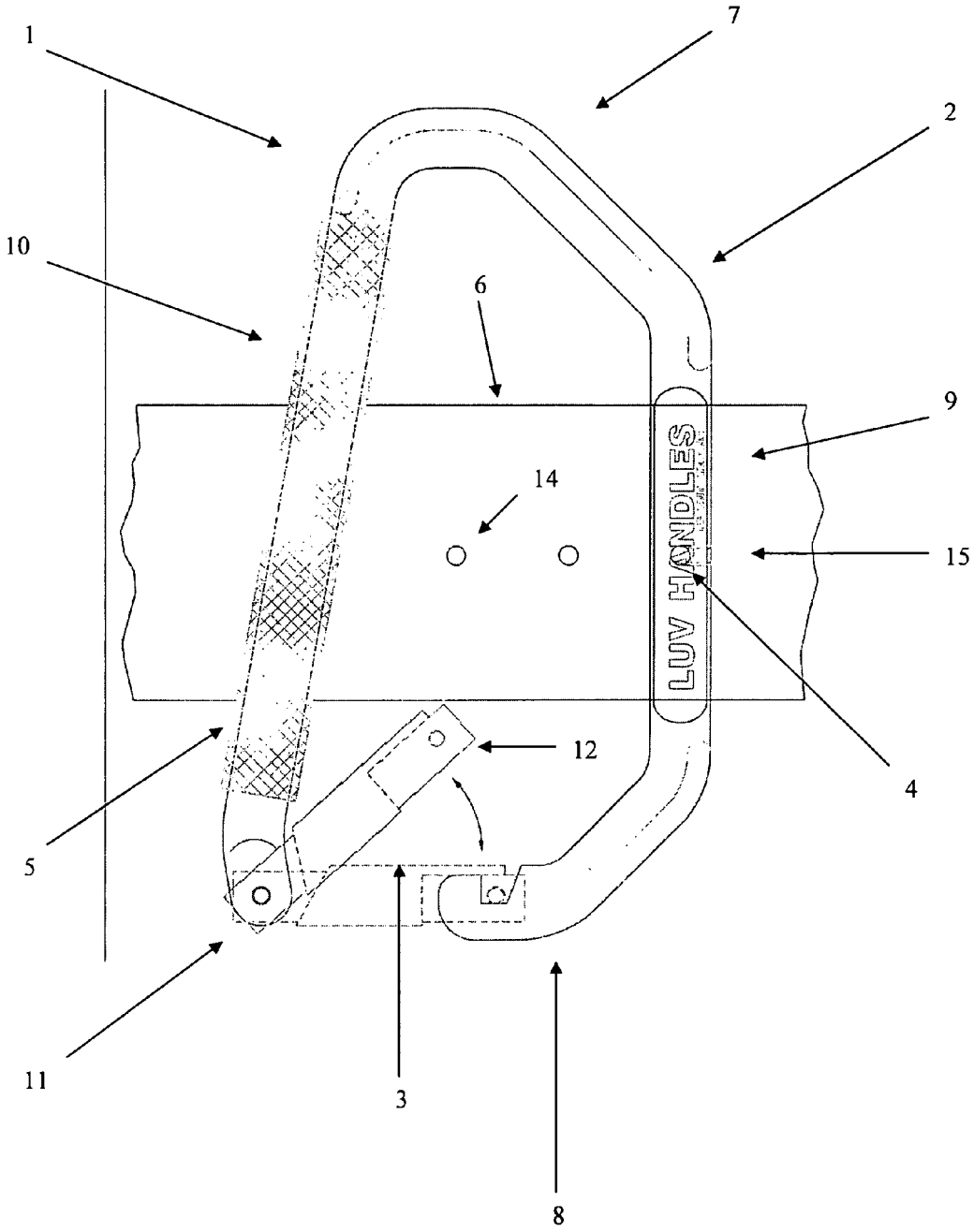
FIG. 2 illustrates a close-up view of the present invention.

In accordance with the foregoing summary, the following presents a detailed description of the preferred embodiment of the present invention.

The vehicle safety belt stabilization device is to be used by a passenger 31, riding in tandem, on a vehicle such as a motorcycle, snowmobile, ATV, wave runner or similar sports vehicle. An example of the use of this device can be seen in FIGS. 1*a*, 1*b*, and 1*c*. The vehicle safety belt stabilization device 32 is preferably attached around the waist of the vehicle operator 30. The passenger 31, riding in tandem, then grasps onto the vehicle safety belt stabilization device 32. As the vehicle accelerates, or changes momentum in anyway, the passenger 31 may use the device 32 as a more effective means to stabilize their balance. A closer view of the vehicle safety belt stabilization device 32 can be seen in FIG. 2. The apparatus preferably comprises a belt 8, at least one carabiner 1, a hand gripping mechanism 5, a sliding pin 4 and a set screw 15. In the preferred embodiment, the passenger 31 attaches two carabiners 1 to a belt 6 worn around the waist of the vehicle operator 30. The passenger 31 then grasps onto the carabiners 1 and uses them to maintain their center of gravity in congruence with the vehicle and the operator 30.

Carabiners are versatile devices, applicable for many different uses. Because of their versatility, carabiners are commercially available in many different shapes and sizes. Despite this variety, all carabiners share the same basic structure. An exemplary carabiner can be seen in FIGS. 3*a* and 3*b*. A carabiner 20 consists of a metallic frame 21 and a gate 22. The frame 21 is a metallic rod bent to form three sides of a quadrilateral, with the gate 22 attached to the frame so as to complete the quadrilateral. The exact location of the gate may vary depending upon the carabiner's intended use. The description of a carabiner frame 21 as forming a quadrilateral is an approximation, as most carabiner frames do not exactly fit the definition. However, most carabiner frames can be approximated as having a top 23, bottom 24, front 26 and rear 27 portions.

The gate 22 is secured to one end of the frame 21 by a spring loaded hinge 28. The spring loaded hinge 28 is used as a pivot point so as to allow the unsecured end of the gate 22 to rotate toward the center of the carabiner 20, creating an open position, as seen in FIG. 3*b*, and a closed position, as seen in FIG. 3*a*. When the gate 22 is in the open position the carabiner 20 is able to hook onto other devices, and when the gate 22 is in the closed position the carabiner 20 is securely attached around a particular device. Thus, the use of the hinged gate 22 allows the carabiner 20 to be easily attached or unattached to a given device.

The carabiner 1 used in the preferred embodiment of the present invention can be seen in FIG. 2. This carabiner 1 is essentially the same as the carabiner 20 previously discussed, but it contains some subtle differences. The primary difference is the fact that the hinged gate 3 is placed so as to create the bottom 8 portion of the carabiner 1, with the frame 2 comprising the front 9, rear 10 and top 7 portions. The hinge 11 is located, approximately, at the intersection between the front 9 and bottom 8 portions of the carabiner 1, with the unhinged end 12 of the gate 3 being positioned towards the front 9 of the frame 2. The positioning of the gate 3 on the bottom 8 of the carabiner 1 allows for convenient attachment of the carabiner 1 to the operator's belt 6. While holding onto the hand grips 5, the passenger 31 may attach the carabiner 1 to the operator's belt 6 with a single downward motion.

The shape of the carabiner 1 used in the preferred embodiment can be seen in FIG. 2. In the preferred embodiment, the gate 3 and frame 2 do not create a parallelogram. Instead, the rear 10 portion of the frame 2, containing the hand grip 5, is longer than the front 9 portion. This creates a situation where both the top 7 and bottom 8 portions of the carabiner 1 slant towards the front 9 portion of the frame 2. The exact shape of the carabiner 1 is not essential, as minor variations in the shape will not effect its operation. Two preferable features of the carabiner shape are that it be large enough to comfortably fit the passengers 31 hand and that the front 9 portion of the carabiner 1 have a belt contact portion 13 so as to allow it to sit comfortably against the belt 6.

Figure 4:
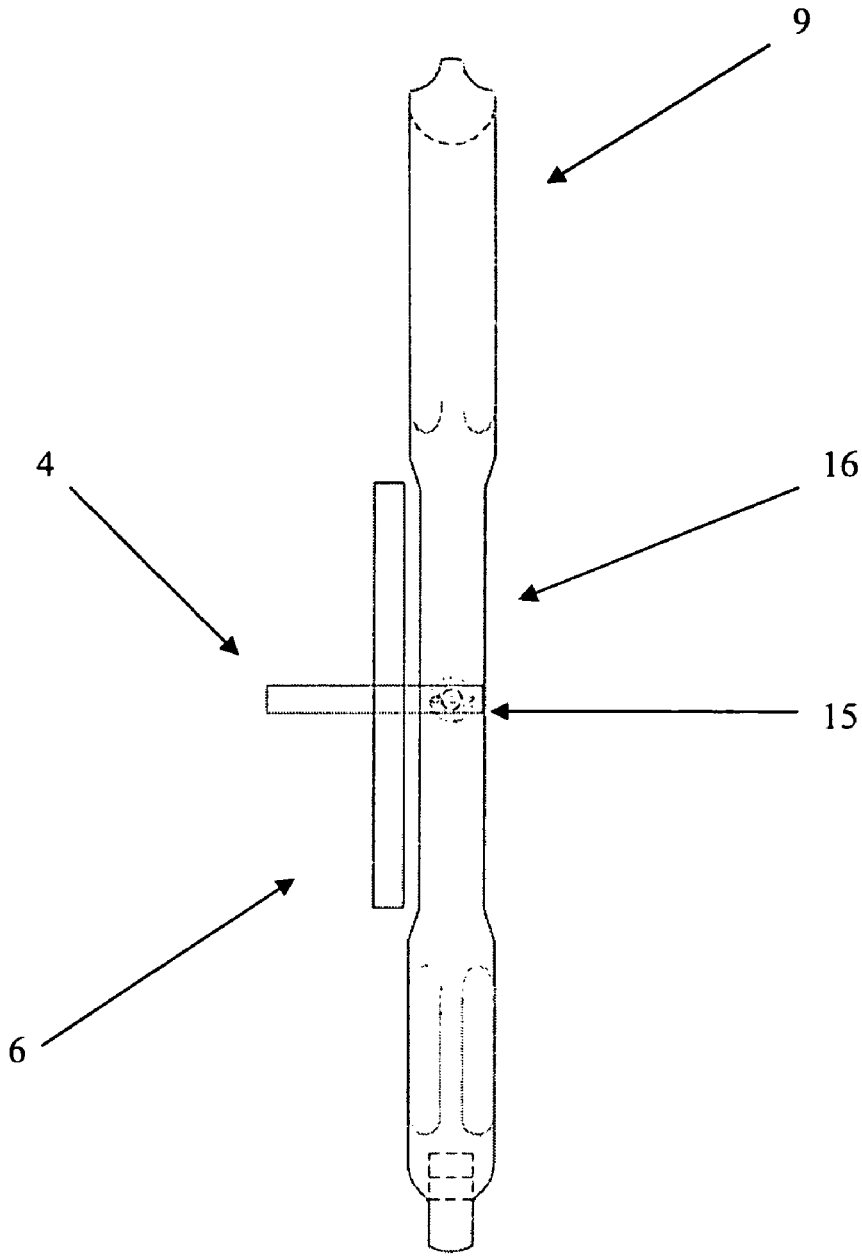
FIG. 4 illustrates a front view of the present invention.

The carabiner 1 is secured to the belt 6 by a sliding pin 4. The sliding pin 4 is attached to the center of the front 9 portion of the carabiner frame 2. The sliding pin 4, consisting of a cylindrical rod, extends outward from the carabiner frame 2 a distance of approximately one-half inch. The sliding pin 4 extends in the direction such that in FIG. 4 the sliding pin 4 may extend to either the left or the right and in FIG. 2 the sliding pin 4 extends either into the page or out of the page. The sliding pin 4 may be made with the capability to extend in either of these directions, making each carabiner 1 reversible. The reversibility of the sliding pin 4 allows for any carabiner 1 to be secured to either the left or the right portion of the belt 6.

The sliding pin 4, positioned in either direction. Is secured by a locking mechanism. In the preferred embodiment, the locking mechanism consists of a set screw 15 set into the anterior wall 16 of the carabiner 1. The set screw 15 is positioned perpendicularly to the sliding pin 4, such that in FIG. 4 the head of the set screw 15 would point out of the page. When the sliding pin 4 is positioned in either the left or right position, the set screw 15 is aligned with a hole in the sliding pin 4. When tightened, the set screw 15 is screwed into the sliding pin 4 so that the sliding pin 4 cannot move from its selected position.

The sliding pin 4 should be set and locked into position before each carabiner 1 is set over the belt 6. To connect the carabiner 1 to the belt 6 the passenger 31 opens the hinged gate 3 and attaches the carabiner 1 around the belt 6. The carabiner 1 is then positioned with the sliding pin 4 aligned with one of several position holes 14 punched into the lateral aspect of the belt 6. The sliding pin 4 may for example be positioned through the position hole 14 in the belt 6. In the preferred embodiment, two carabiners 1 are attached to the belt 6, one on the left side of the vehicle operators 30 waist, and the other on the right side of the vehicle operator's 30 waist. As there are several position holes 14 punched into the belt 6 the exact position of each carabiner 1 may be adjusted for an individual passenger's 31 comfort.

Attached to the frame 2 of the carabiner 1 is a gripping mechanism 5 which allows for the passenger 31 to comfortably grasp the carabiner 1. The gripping mechanism 5 may be a rubber sleeve of approximately one inch in diameter placed around the rear portion 10 of the carabiner 1. The preferred embodiment has been chosen because it maximizes comfort while still acting as an effective handgrip, but the gripping mechanism 5 could take many different forms and may consist of many different types of materials.

While the invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims, which are incorporated herein by reference. For example, a single belt may be replaced with one or more straps or other attachment means on the vehicle operator, or mounted to the vehicle itself. Also, while carabiners are preferred, other handle mechanisms may be employed of a similar nature. The handle mechanisms may be attached to the belt or straps by other means than the pin and set screw arrangement described above.

What is claimed is:

1. A vehicle safety belt stabilization device, to be used by a passenger riding a vehicle in tandem with a vehicle operator, said vehicle safety belt stabilization device comprising:

a belt;

at least one handle device adapted to be removably secured to said belt and;

a sliding pin attached to said handle device, said sliding pin capable of being placed through a hole in said belt such that said handle device is attached to said belt.

2. The vehicle safety belt stabilization device of claim 1 wherein said sliding pin is adjustable to more than one position.

3. The vehicle safety belt stabilization device of claim 2 further comprising a set screw attached to a frame of said handle device such that said set screw is capable of securing said sliding pin in a chosen position.

4. The vehicle safety belt stabilization device of claim 1 wherein said handle device includes a gate about a spring loaded hinge such that said gate may be opened by placing pressure on the unhinged end of said gate, and such that when said gate is released said gate automatically returns to closed position.

5. The vehicle safety belt stabilization device of claim 1 wherein said handle device contains a hand grip.

6. The vehicle safety belt stabilization device of claim 1 wherein said handle device is a carabiner.

7. The vehicle safety belt stabilization device of claim 4 wherein said handle device is a carabiner.

8. The vehicle safety belt stabilization device of claim 7 further comprising a set screw attached to said carabiner frame such that said set screw is capable of securing said sliding pin in a chosen position.

9. The vehicle safety belt stabilization device of claim 8 wherein said hinge is a spring loaded hinge such that said gate may be opened by placing pressure on the unattached end of said gate, and such that when said gate is released said gate automatically returns to a closed position.

10. The vehicle safety belt stabilization device of claim 9 wherein said carabiner includes a hand grip attached to said carabiner so that said hand grip allows the passenger to grip said carabiner.

11. The vehicle safety belt stabilization device of claim 10 wherein said hinged gate is positioned on the bottom portion of the frame of said carabiner.

12. The vehicle safety belt stabilization device of claim 11 wherein said vehicle is a motorcycle.

13. The vehicle safety belt stabilization device of claim 11 wherein said vehicle is a watercraft.

14. The vehicle safety belt stabilization device of claim 11 wherein said vehicle is a snowmobile.

15. The vehicle safety belt stabilization device of claim 11 wherein said vehicle is an all terrain vehicle.

16. A vehicle safety belt stabilization device, to be used by a passenger riding a vehicle in tandem with a vehicle operator, said vehicle safety belt stabilization device comprising:

at least one strap adapted to be secured to said operator; and at least one carabiner removably secured to said strap, said carabiner having an attachment member which allows said at least one carabiner to be adjustably secured to said strap.

17. The vehicle safety belt stabilization device of claim 16 wherein said carabiner includes a handle grip means.

18. The vehicle safety belt stabilization device of claim 17 wherein said attachment member includes a sliding pin.

19. The vehicle safety belt stabilization device of claim 17 wherein said carabiner contains a hinged gate.

20. The vehicle safety belt stabilization device of claim 19 wherein said hinged gate is spring loaded.

* * * * *

UNITED STATES PATENT AND TRADEMARK OFFICE

CERTIFICATE OF CORRECTION

PATENT NO. : 7,114,196 B1
APPLICATION NO. : 10/830815
DATED : October 3, 2006
INVENTOR(S) : Gary Cicio It is certified that error appears in the above-identified patent and that said Letters Patent is hereby corrected as shown below:

Title Page, item 57 (abstract), line 6, please delete “allow” and insert --allows --
In column 1, line 28, please delete “passengers” and insert --passenger’s --
In column 2, line 30, please delete “EMBOFDIMENT” and insert --EMBODIMENT--
In column 2, line 47, please delete “8” and insert -- 6--
In column 3, line 41, please delete “passengers” and insert --passenger’s --
In column 3, line 57, please delete “The sliding pin 4, positioned in either direction. Is secured by a locking mechanism” and insert --The sliding pin 4, positioned in either direction, is secured by a locking mechanism --
In column 4, line 10, please delete “operators” and insert --operator’s --

Signed and Sealed this

Thirteenth Day of February, 2007

JON W. DUDAS
*Director of the United States Patent and Trademark Office*